US006227891B1

(12) United States Patent
Collin et al.

(10) Patent No.: US 6,227,891 B1
(45) Date of Patent: May 8, 2001

(54) RETRACTABLE HANDLE FOR POWER CONNECTOR

(75) Inventors: Edwin Collin, Southington; Peter Bialobrzeski, Madison, both of CT (US)

(73) Assignee: Litton Systems Inc., Woodland Hills, CA (US)

( * ) Notice: Subject to any disclaimer, the term of this patent is extended or adjusted under 35 U.S.C. 154(b) by 0 days.

(21) Appl. No.: 09/497,769

(22) Filed: Feb. 4, 2000

(51) Int. Cl.[7] ..... H01R 13/62; H01R 13/213
(52) U.S. Cl. ..... 439/314; 439/483
(58) Field of Search ..... 439/312, 313, 439/314, 317, 318, 319, 320, 321, 322, 323, 333, 476.1, 483, 484; 403/322.4, 322.2, 322.3

(56) References Cited

U.S. PATENT DOCUMENTS 2,281,739 * 5/1942 Wright ..... 439/271
5,454,731 * 10/1995 Dickie ..... 439/484
5,931,694 * 8/1997 Kato et al. ..... 439/511

* cited by examiner

*Primary Examiner*—Brian Sircus
*Assistant Examiner*—Javaid Nasri
(74) *Attorney, Agent, or Firm*—Lowe Hauptman Gilman & Berner, LLP

(57) ABSTRACT

The present invention is directed to a retractable handle which has an extended rotatable position and is movable to a retracted, stowed condition. The handle advantageously can be moved to an extended position in which a detent provides sufficient force so that the handle can be used in operation for coupling or de-coupling the connector from a mating connector. Advantageously, when in the stowed retracted position, the handle is unobtrusive and should not interfere with moving objects that are near by. The handle includes a detent mechanism which provides sufficient force to hold the handle in either the extended rotatable position or the stowed, retracted position.

17 Claims, 2 Drawing Sheets

RETRACTABLE HANDLE FOR POWER CONNECTOR

FIELD OF THE INVENTION

The present invention relates generally to electrical connectors, and more particularly, to a retractable handle for a rotatable electrical connector.

BACKGROUND OF THE INVENTION

A rotatable electrical connector is disclosed in U.S. application Ser. No. 09/350,988 filed Jul. 12, 1999 entitled "Handle Operated Power Connector", the disclosure of which is hereby incorporated by reference in its entirety into this specification.

This large connector requires a relatively large force to couple and uncouple and requires a handle 42 which provides a significant mechanical advantage. Disadvantageously, this large handle 42 can interfere with moving objects nearby, particularly when the connector is mounted on a moving apparatus such as a train, railroad car or truck.

Accordingly, a need exists in the art for a retractable handle which can be conveniently stowed away in a retracted position after the connector has been put into a coupled position.

SUMMARY OF THE INVENTION

It is, therefore, an object of the present invention to provide a retractable handle which can be moved from an extended rotatable position to a retracted stowed position.

Another object of the present invention is to provide a retractable handle which can provide a large force or mechanical advantage when the handle is moved to an extended rotatable position from a retracted stowed position.

Another object of the present invention is to provide a handle which is not easily moved from an extended rotatable position while in operation, coupling or de-coupling and also is secured when in a retracted stowed position.

It is another object of the present invention to provide a handle in which a detent mechanism provides sufficient force to retain the handle in an extended rotatable position so as to not easily move an operation and the same detent provides sufficient force to hold the handle fixed and resist shock and vibration when in a stowed retracted position.

The present invention is directed to a retractable handle which has an extended rotatable position and is movable to a retracted, stowed condition. The handle advantageously can be moved to an extended position in which a detent provides sufficient force so that the handle can be used in operation for coupling or de-coupling the connector from a mating connector. Advantageously, when in the stowed retracted position, the handle is unobtrusive and should not interfere with moving objects that are near by. The handle includes a detent mechanism which provides sufficient force to hold the handle in either the extended rotatable position or the stowed, retracted position.

These and other objects of the present invention are achieved by a handle for a rotatable electrical connector including a handle assembly. The handle assembly includes a handle, a handle holder and a detent mechanism. The handle has a first detent and a second detent. The handle holder has a fixed stop surface. The handle is pivotable relative to the handle holder wherein the handle is movable from an extended position in which the detent mechanism engages the first detent and the handle contacts the fixed stop surface and a stowed position in which the detent mechanism engages the second detent.

The foregoing and other objects of the present invention are achieved by a rotatable electrical connector including a receptacle and a plug rotatably mateable with the receptacle. A handle assembly is located on one of the plug and the receptacle. The handle has a first detent and a second detent. The handle holder has a fixed stop surface. The handle is pivotable relative to the handle holder. The handle is movable from an extended position in which the detent mechanism engages the first detent and the handle contacts the fixed stop surface and a stowed position in which the detent mechanism engages the second detent.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
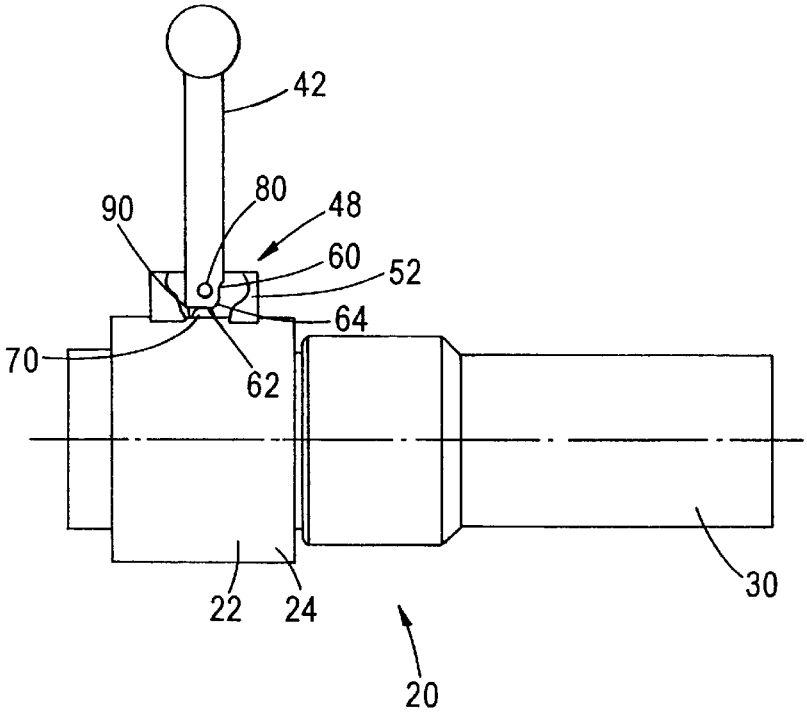
FIG. 1 is a side elevational view of a plug assembly with the handle depicted in an extended rotatable position according to the present invention.
Figure 2B:
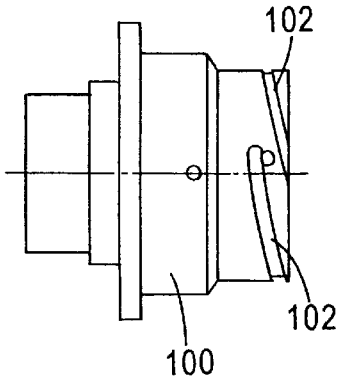
FIG. 2B is a side elevational view of a receptacle.

Referring first to FIG. 1, a plug assembly 20 includes a coupling ring assembly 22 and a generally cylindrical body 30. The coupling ring assembly 22 is rotatable on the body 30. Although the plug assembly 20 is depicted in a horizontal orientation in FIG. 1, it should be understood that the present invention is usable in any orientation. The plug assembly 20 mates with a receptacle 100 depicted in FIG. 2B. The plug assembly 20 and receptacle 100 are described in greater detail in Ser. No. 09/350,988, the disclosure of which is hereby incorporated by reference in its entirety.

The coupling ring assembly 22 includes a generally cylindrical coupling ring 24, and a handle assembly, generally indicated at 40, according to the present invention. The handle assembly 40 includes a handle 42 and a handle holder assembly 48. The handle holder assembly 48 includes a pair of walls 50, 52, which extend in a longitudinal direction. The walls 50, 52 are parallel to each other and are spaced from each other such that an end portion of handle 42 extends between walls 50, 52.

The handle 42 includes a first detent 60 which is located on a longitudinal surface of handle 42. A second detent 62 is located on an end surface of the handle 42. The two detents 60, 62 are connected by a rounded surface 64. The walls 50, 52 have a hole extending therethrough in a transverse direction and handle 42 has a similar hole. A pivot pin 80 extends into or through walls 50, 52 and the hole in handle 42 such that the handle is rotatable 90° in a clockwise direction as depicted in FIG. 1.

A fixed stop surface 90 is located in walls 50, 52 and prevents rotation of the handle 42 in a counter clockwise direction as depicted in FIG. 1.

Figure 2A:
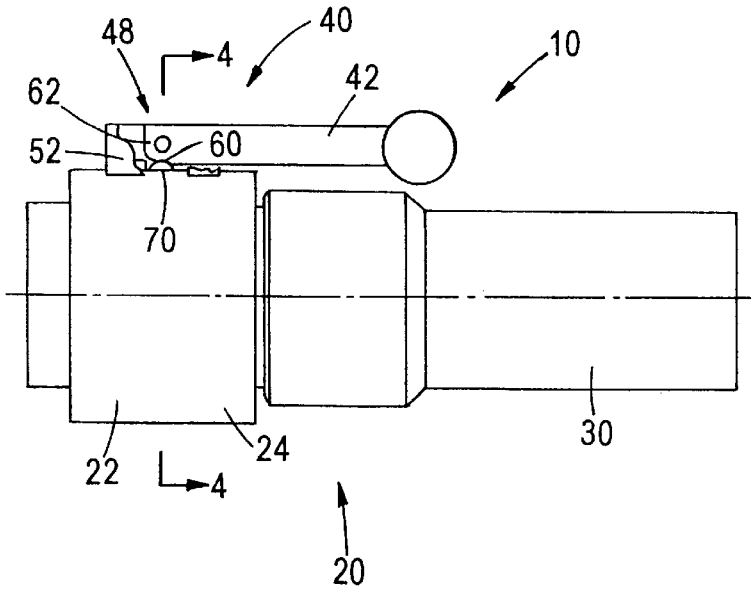
FIG. 2A is a side elevational view with the handle depicted in a retracted stowed position.
Figure 3:
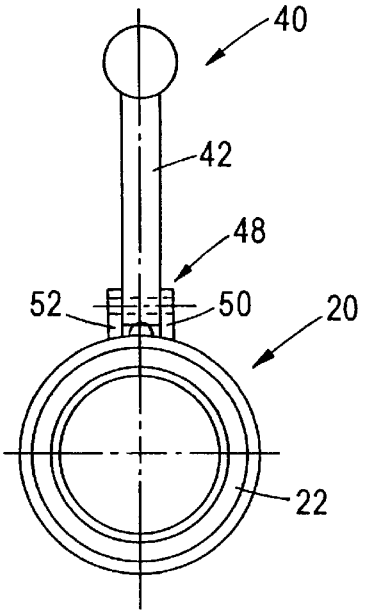
FIG. 3 is a front elevational view of the present invention with the handle depicted in an extended rotatable position.
Figure 4:
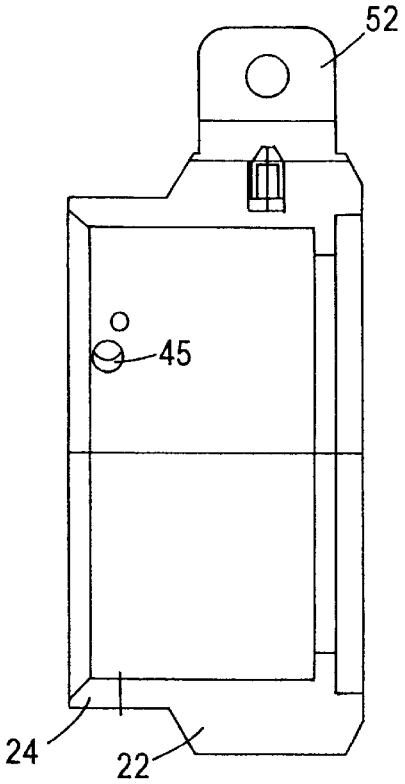
FIG. 4 is a side elevational cross-sectional view of a coupling ring taken along line 4—4 in FIG. 2A with portions of the handle assembly omitted for clarity.

In operation, as depicted in FIG. 1, the handle 42 is depicted in an extended rotatable position. A detent mechanism 70 is positioned between handle 42 and an outer surface of the coupling ring assembly 22. Alternatively, a horizontally extending wall (not shown) can connect the walls 50, 52 and the detent mechanism 70 can be positioned between the wall and the handle 42. As depicted in FIG. 1, the detent mechanism 70 is engaged with the detent 62. The detent mechanism 70 advantageously applies sufficient force so that handle 42 can be used to couple and uncouple the rotatable coupling ring assembly 22 to the stationary receptacle 30. The coupling ring assembly 22 includes plurality of pins 45 (see FIG. 4) which engage with corresponding spiral ramps in the receptacle 100. The coupling and uncoupling of the plug assembly 20 and the receptacle is described in co-pending Ser. No. 09/350,988. Alternatively, the handle assembly 40 can be mounted directly to the plug assembly 20 or the receptacle 100. The handle 42 is sized such that the opposite walls thereof are in contact with walls 50, 52 so that a large rotation force in a clockwise or counterclockwise direction, as depicted in FIG. 3 can be applied to the coupling ring assembly 22. As depicted in FIG. 2, the handle 42 is depicted in a retracted, stowed position. The detent mechanism 70 is engaged with the detent 60. As depicted in FIGS. 1 and 2 the handle 42 is rotated in a forward longitudinal direction to be placed in the stowed position depicted in FIG. 2 and can be rotated in the opposite direction to be moved from the retracted position to the extended position.

Advantageously, it should now be appreciated that a handle assembly has been described in which the handle has fixed detents which allow the handle to be positioned in an extended, rotatable position and a retracted, stowed position. The detent mechanism provides sufficient force as to not easily allow the handle 42 to be moved while in operation, coupling or de-coupling the connector from its mate. While in the extended operational position the handle will have a surface that provides a fixed stop position against the coupling nut stop surface for preventing rotation of the handle 42 in the extended position. While in the stowed retracted position, the detent advantageously provides sufficient force to hold the handled fixed and resists shock and vibration.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A handle for an electrical connector having a rotatable ring, the electrical connector having a male portion and a female portion, comprising:

a handle assembly including a handle, a handle holder and a detent mechanism;

said handle having a first detent and a second detent;

said handle holder having a fixed stop surface;

said handle being pivotable relative to said handle holder;

wherein said handle is movable from an extended position in which said detent mechanism engages said first detent and said handle contacts said fixed stop surface and a stowed position in which said detent mechanism engages said second detent, and wherein when in said extended position, said handle is used to uncouple the male portion and the female portion and when in said stowed position the male portion and the female portion are coupled together.

2. The handle of claim 1, wherein said handle holder includes a pair of walls on either side of said handle and a pin extending into each of said pair of walls and through said handle.

3. The handle of claim 1, wherein said handle extends radially outwardly from said connector when in said handle is in said extended position.

4. The handle of claim 1, wherein said handle extends in a longitudinal direction relative to said connector when said stowed position.

5. The handle of claim 1, wherein said detent mechanism is located between said handle and one of a male connector body and a female connector body.

6. The handle of claim 1, wherein said detent mechanism is located between said handle and said handle holder.

7. The handle of claim 1, wherein said handle has a first rounded portion on an end thereof for engagement with said detent mechanism in said extended position and a second rounded portion on a longitudinal surface thereof for engagement with said detent mechanism in said stowed position.

8. The handle of claim 1, wherein the male portion is a receptacle and the female portion is a plug.

9. An electrical connector having a rotatable ring, the electrical connector having a male portion and a female portion, comprising:

a receptacle;

a plug rotatably mateable with said receptacle;

a handle assembly including a handle, a handle holder and a detent mechanism located on one of said plug and said receptacle;

said handle having a first detent and a second detent;

said handle holder having a fixed stop surface;

said handle being pivotable relative to said handle holder;

wherein said handle is movable from an extended position in which said detent mechanism engages said first detent and said handle contacts said fixed stop surface and a stowed position in which said detent mechanism engages said second detent, and wherein when in said extended position, said handle is used to uncouple the male portion and the female portion and when in said stowed position the male portion and the female portion are coupled together.

10. The electrical connector of claim 9, wherein said handle holder includes a pair of walls on either side of said handle and a pin extending into each of said pair of walls and through said handle.

11. The electrical connector of claim 9, wherein said handle extends radially outwardly from said connector when in said handle is in said extended position.

12. The electrical connector of claim 9, wherein said handle extends in a longitudinal direction relative to said connector when said stowed position.

13. The electrical connector of claim 9, wherein said detent mechanism is located between said handle and one of a male connector body and a female connector body.

14. The electrical connector of claim 9, wherein said detent mechanism is located between said handle and said handle holder.

15. The electrical connector of claim 9, wherein said handle has a first rounded portion on an end thereof for engagement with said detent mechanism in said extended position and a second rounded portion on a longitudinal surface thereof for engagement with said detent mechanism in said stowed position.

16. The electrical connector of claim 9, wherein said handle assembly is mounted to a coupling ring.

17. The electrical connector of claim 9, wherein the male portion is a receptacle and the female portion is a plug.

* * * * *